United States Patent [19]

Kovaleski et al.

[11] 4,377,264

[45] Mar. 22, 1983

[54] SPOOL HANDLING DEVICE

[75] Inventors: Joseph J. Kovaleski, Easton; Gordon L. Bauer, Shelton, both of Conn.

[73] Assignee: Wyrepak Industries, Inc., Bridgeport, Conn.

[21] Appl. No.: 275,645

[22] Filed: Jun. 22, 1981

[51] Int. Cl.[3] ..... B65H 54/12; B65H 67/06

[52] U.S. Cl. ..... 242/25 R; 242/16

[58] Field of Search ..... 242/25 R, 25 A, 18 R, 242/68.4, 129.51, 78, 79, 7.14, 7.15, 58.6, 16, 17

[56] References Cited

U.S. PATENT DOCUMENTS

| | | | |
|---|---|---|---|
| 2,551,362 | 5/1951 | Carter et al. | 242/68.4 UX |
| 2,711,293 | 6/1955 | Hanson | 242/25 R X |
| 3,831,871 | 8/1974 | Ikegami et al. | 242/25 R |
| 3,918,650 | 11/1975 | Kemel | 242/25 R |
| 4,130,249 | 12/1978 | Steinhilber | 242/25 R |

FOREIGN PATENT DOCUMENTS

| | | | |
|---|---|---|---|
| 496367 | 10/1950 | Belgium | 242/25 R |

*Primary Examiner*—Stanley N. Gilreath
*Attorney, Agent, or Firm*—H. Gibner Lehmann; K. Gibner Lehmann

[57] ABSTRACT

An apparatus for supporting and handling spools of the type intended to carry wire, and for rotating such spools at relatively high speeds in order to fill them. The apparatus comprises a housing having an access opening and a swivel carrier on the housing, capable of supporting the spool on one of its ends and of shifting the spool from the exterior of the housing to the interior thereof. The carrier, once it arrives at the interior, can lower the spool to an operative position on a special drive mechanism that is capable of rotating it. In addition, a traverse mechanism is provided in the housing, for guiding and reciprocating a strand of wire as it is being wound onto the spool. By virture of the arrangement wherein the carrier can swing the spool between the exterior and interior of the housing, lifting and handling of the spool is greatly facilitated. This is particularly important where spools weighing hundreds of pounds are being employed.

31 Claims, 10 Drawing Figures

SPOOL HANDLING DEVICE

BACKGROUND

This invention relates generally to equipment for handling wire-carrying spools, and more particularly to specialized devices of the type adapted to facilitate both handling and filling of such spools.

Until recently, most of the wire-carrying spools that were in use were of a type having cental openings along their axes, such that suitable spindles could be received in the openings, and the spools rotatably driven by the spindle. An example of such a spool is shown in U.S. Pat. No. 2,647,704. Another spool of this type is illustrated in U.S. Pat. No. 3,425,647.

A newer type of spool is shown in applicant's U.S. Pat. No. 4,140,289, and applicant's co-pending application U.S. Ser. No. 126,065, now U.S. Pat. No. 4,269,371. The constructions shown in the latter two specifications differ considerably from those of the first-mentioned patents in that in place of the central, axial opening, there was a single tie bolt which held the conical end flanges together, and maintained the central cylindrical body under continual compression. The reasoning for producing a spool having such a configuration resided in the fact that such a construction was considerably simpler than the spools previously known, many of which were constituted as multiple parts of sheet metal that were welded together. In addition, spools of the type having the single tie bolt could be readily disassembled, and conical end flanges nested with one another, for storage. Also, by including different sized cylindrical bodies, the capacity of a particular spool could be changed in order to accept greater or lesser quantities of wire. Other advantages of these constructions are outlined in the respective cases, U.S. Pat. No. 4,140,289 and U.S. Ser. No. 126,065, and accordingly need not be repeated.

These spools in many cases tended to be physically large, and heavy when filled with wire. It was found that a convenient means for lifting them was to provide an eye at the one end of the tie bolt, this eye being disposed generally at the axis of the spool, thus simplifying the lifting and handling of the same.

Naturally, however, spools of this type did not have the central axial bore that was required in order to receive a power-driven spindle. Thus, filling spools of this type with wire represented somewhat of a difficulty in that the conventional wire-handling equipment could not be readily employed. Accordingly other alternatives had to be found.

Where relatively large spools weighing hundreds of pounds were being employed, it was awkward or impossible for the operator to manually lift or position such units, and alternate arrangements for processing these spools had to be devised.

SUMMARY

The problems associated with filling spools of the type noted above are largely obviated by the present invention which has for an object the provision of a spool handling device which is simple in construction and reliable in operation, and which is especially effective in handling spools that are too large to be easily manipulated by hand.

Yet another object is the provision of a spool handling device as above characterized, which is safe in operation and reliable over extended periods of use.

Still another object is to provide a spool handling machine of the type especially adapted for use with spools of the kind having no central or axial opening, particularly spools of the type shown in U.S. Pat. No. 4,140,289.

A further object is to provide spool handling equipment which does not require exhausting manual operations, or other operations that would involve exertion or strength on the part of the operator.

Still another object is the provision of equipment as above characterized wherein the spool is substantially completely enclosed in a safety housing when the spool is being filled, to eliminate the possibility of injury to the operator.

The above objects are accomplished by a spool handling device comprising a housing having an access opening, carrier means on the housing, for supporting a spool on end at the housing exterior and for enabling shifting of the spool through the access opening to the housing interior and including means for lowering the spool to an operative position after it has been shifted. There are provided powered means for rotating the spool when it is in its lowered position, and a traverse mechanism carried by the housing, having means for guiding a strand of wire onto the spool and for reciprocating the strand along a path substantially parallel to the axis of the spool as the latter is being rotatably driven during filling of the spool with wire. The arrangement is such that an empty spool can be lifted into position over the carrier while the latter is outside the housing, and thereafter the carrier manually swung to a position wherein it is disposed inside the housing and then lowered an extent to position the bottom portion of the spool on a turntable. The wire strand can be threaded, and then the spool turnably driven at relatively high speeds. After the spool is filled with the desired amount of wire, the carrier lifts it off the turntable and enables it to be swung to a position outside the housing, to permit removal of the spool from the carrier and substitution of a new spool in its place, for filling.

During filling, the spool can be kept completely enclosed in the housing, to minimize or eliminate the possibility of injury to the operator.

Due to the use of rugged and sturdy components, relatively high speed operation can be achieved, and take-up speeds on the order of 5000 feet per minute have been realized with the apparatus of the present invention.

Other features and advantages will hereinafter appear.

In the drawings, illustrating a preferred embodiment of the invention:

Figure 5:
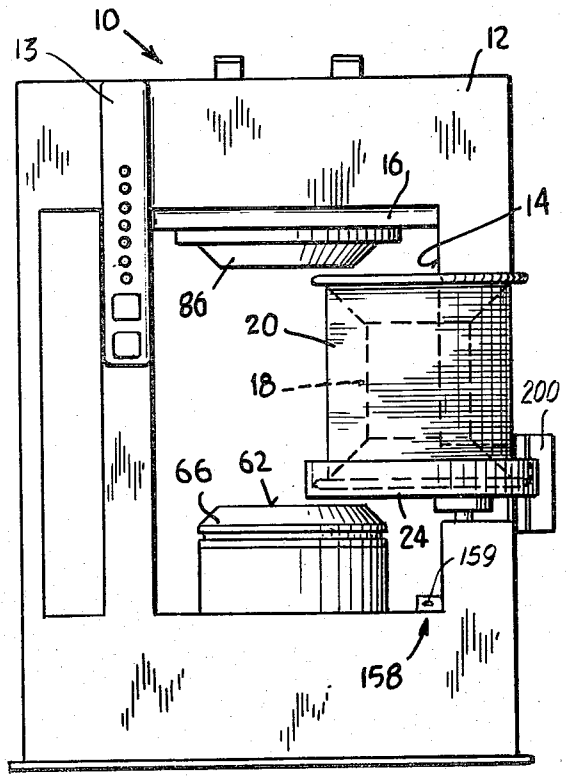
FIG. 5 is a view like FIG. 4, except showing the carrier having been swung to a position outside of the housing, to permit removal of the spool and substitution of a new unit.
Figure 4:
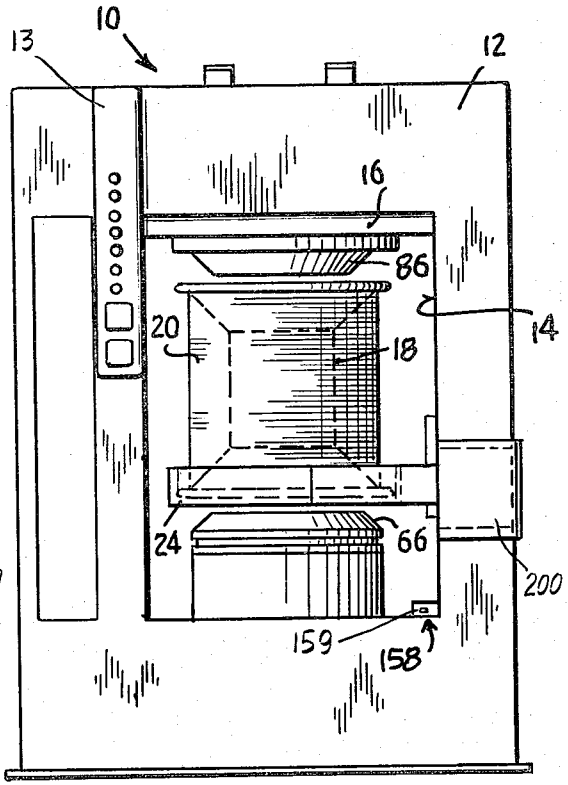
FIG. 4 is a front elevational view of the equipment, with the shutter open and the carrier supporting the spool in a position above a supporting turntable on the housing.
Figure 3:
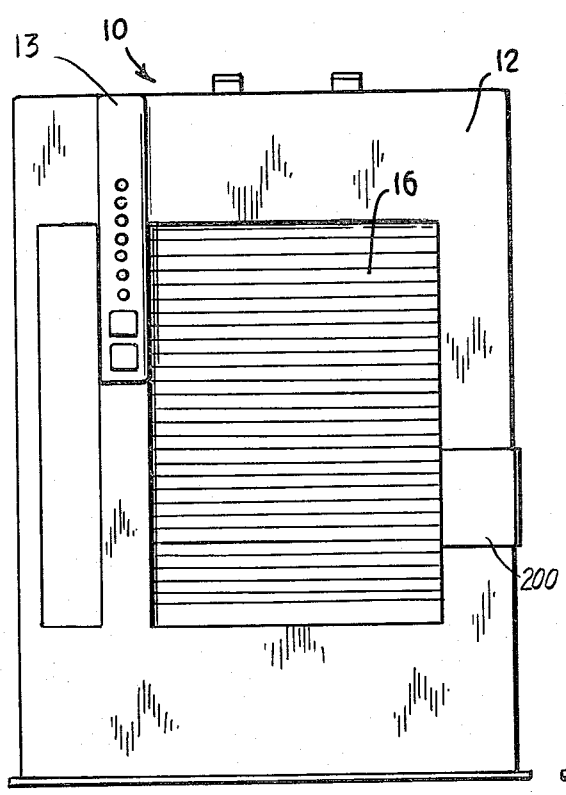
FIG. 3 is a front elevational view of the equipment, showing the housing and a protective shutter in its closed position wherein it closes off the access opening of the housing.

Referring first to FIGS. 1 and 3–5 there is illustrated the improved spool-handling equipment of the present invention, the equipment being generally designated by the numeral 10 and comprising a housing 12 having a control panel 13, and an access opening 14 which is intended to be selectively closed off by a movable shutter 16 as in FIG. 3, when the equipment is operating. FIGS. 4 and 5 show a spool 18 filled with a quantity of wire 20, supported on a cup-like tray 24 having an integral supporting arm 25 which in turn is connected to an operator or lift mechanism, FIG. 1, generally designated 26.

The mechanism 26 is in the form of a tubular sleeve 27 which is carried on a generally vertical operator shaft 28 by means of bearings 29, 30. The shaft 28 is vertically movable with respect to the housing, in a pair of bearings 32, 34, and has threaded in its end, a lifting screw 36. The shaft 28 and screw 36 are rigid with respect to one another.

Referring again to FIG. 1, there is associated with the lifting screw 36 a drive nut 38, which is turnably driven by a suitable electric motor 40 through a speed-reduction gear box 42.

Figure 2:
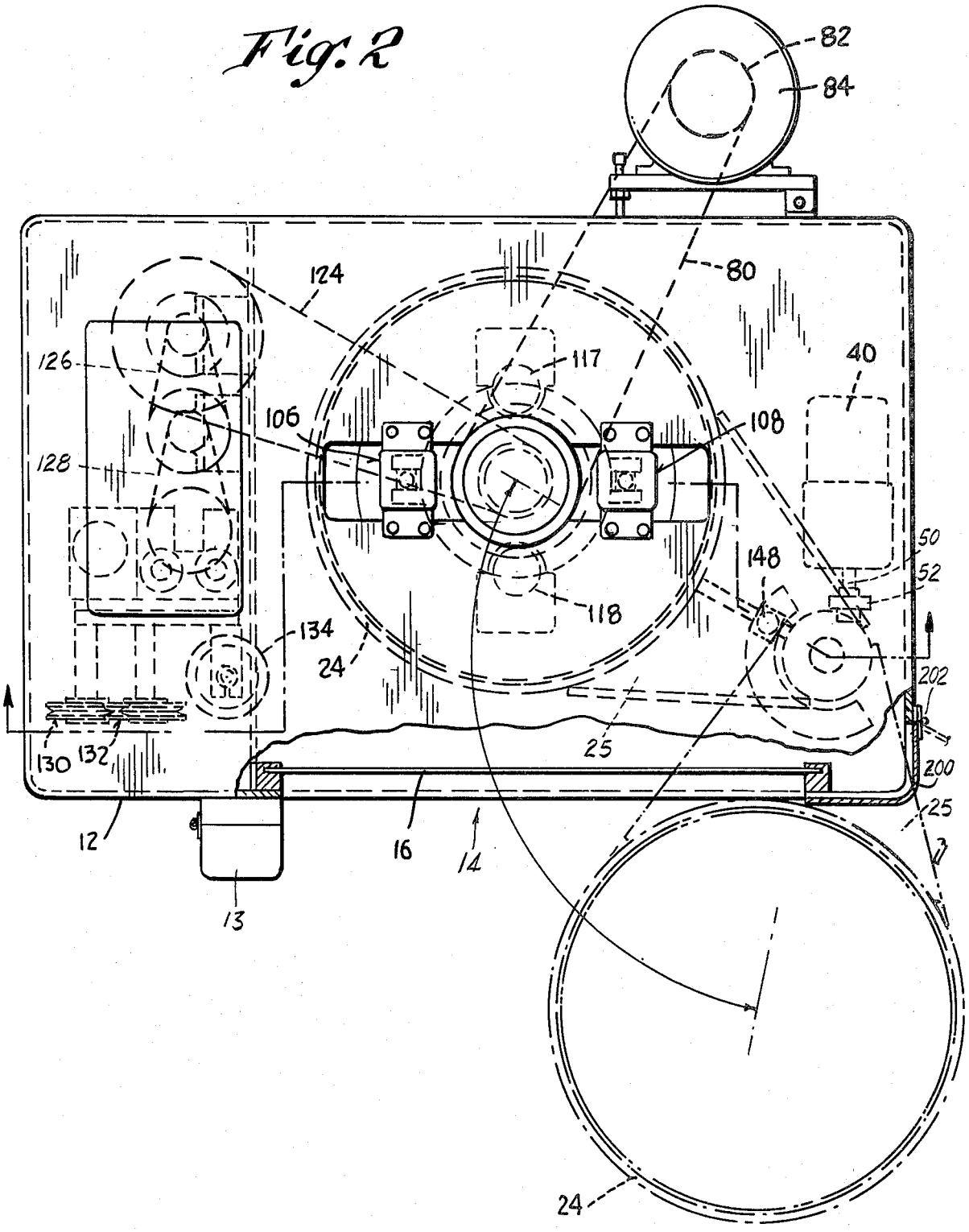
FIG. 2 is a top plan view of the equipment, illustrating in dotted outline the carrier as it would appear when disposed in a first position at the exterior of the housing, and a second position at the housing interior.

As shown in FIG. 2, the shaft 50 of the motor 40 is connected to a coupling 52, which in turn drives the input shaft of the gear box assembly 42. The screw 36 is keyed at the gear box 42 to prevent turning, which also restrains the shaft 28 against turning movement.

With such an arrangement, the tray 24 can be manually swung from a first position shown in FIG. 4, to a second position shown in FIG. 5. In addition, it will be readily understood that upon operation of the motor 40, the shaft 28 will be driven in an upward vertical direction, thereby carrying the tray 24 with it. In operation, the tray 24 can be lifted to a raised position, FIG. 4, and then manually swung outwardly by the operator, as in FIG. 5, in order to remove the spool 18, or to install a second spool which is intended to be filled with wire.

Figure 1:
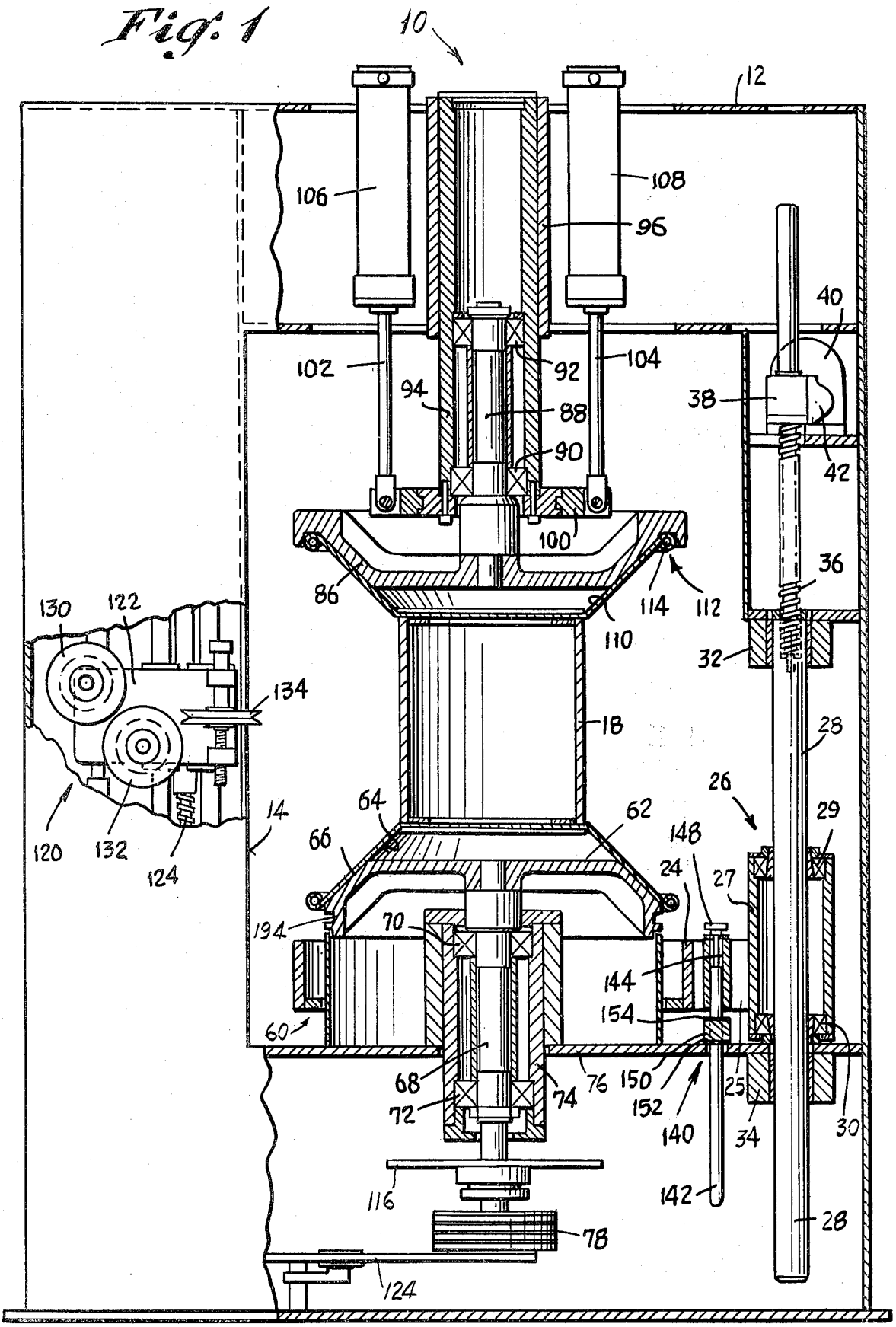
FIG. 1 is a vertical section of the improved spool-handling equipment of the present invention, showing various details of the construction.
Figure 10:
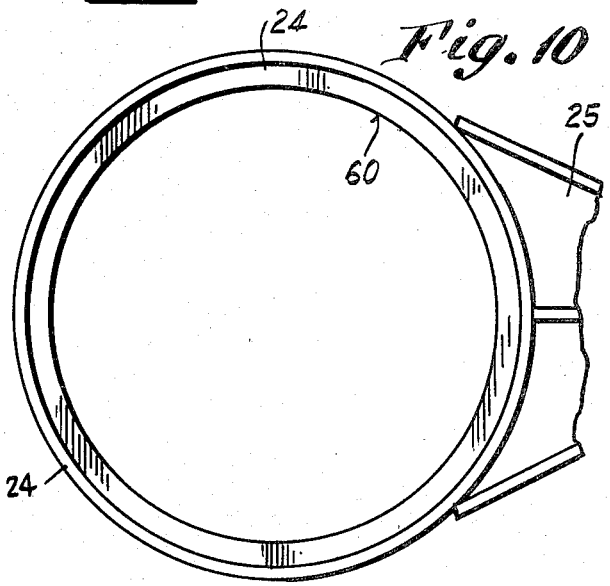
FIG. 10 is a top plan view of the carrier, particularly illustrating a central opening therein through which the turntable can extend, for engagement with the lower end of a spool.

As shown in FIG. 10, the tray 24 has a central opening 60 which provides a clearance space at the underside of the spool 18, such that this underside can be engaged by and rest upon a driven turntable 62. Such engagement is illustrated in FIG. 1, wherein the conical surface 64 of the spool is shown resting on a cooperable frusto-conical surface 66 of the turntable 62. The turntable is carried on a vertical spindle 68 which is supported on bearings 70, 72 that are fitted in a tubular sleeve 74 which is stationary with respect to the adjacent horizontal wall 76 of the frame of the housing 12. Disposed at the bottom of the spindle 68 are multiple pulleys 78, one of which carries a belt 80 (FIG. 2) that extends to an additional, drive pulley 82 that is carried on an additional electric motor 84, FIG. 2. In this way, relatively high-speed turning movement can be imparted to the turntable 62 when the motor 84 is operated, as will be explained below.

Referring again to FIGS. 1, 4 and 5, there is disposed above the spool 18 an advanceable and retractable follower 86 which is carried on an additional vertical spindle 88. The latter is supported on suitable bearings 90, 92, which in turn are carried on a plunger 94 that is slidable with respect to a bearing sleeve 96 in the housing 12. Disposed at the lower end of the plunger 94 is a lifting ring 100 which is connected to two piston rods 102, 104 that extend into hydraulic cylinders 106, 108 respectively. The cylinders 106, 108 are pressured through suitable hydraulic valves, in a conventional manner, in order to effect lifting movement of the follower 86. FIG. 1 shows the follower 86 in its fully advanced or downward position, wherein it tightly engages the upper conical surface 110 of the spool 18. As shown, the follower 86 also has a frusto-conical configuration.

In addition, there is provided at the periphery of the follower 86 an annular groove 112 which is adapted to receive the curled-over rim 114 of the spool 18, as in FIG. 1, in order to provide an improved retention of the upper end of the spool 18 when the follower 86 is fully advanced.

Braking of the turntable 62 is accomplished by a brake disk 116 which is engaged by brake shoes 117, 118, FIG. 2. The shoes 117 and 118 are omitted from FIG. 1, for clarity.

Further in accordance with the invention, there is provided a traverse mechanism generally designated by the numeral 120, the mechanism comprising a carriage 122 which is movable vertically along a drive screw 124 that is turnably driven at a suitable rate through a series of drive pulleys that are ultimately powered through belts, from the electric motor 84. In FIG. 2, these belts are indicated by the numerals 80, 124, 126 and 128; the pulleys that are associated therewith are shown in dotted outline in FIG. 2.

Disposed on the carriage 122 are three guide pulleys 130, 132 and 134, the pulleys 130, 132 being disposed in a vertical plane, and the pulley 134 being horizontal. These pulleys are intended to guide a strand of wire as it is being wound upon the spool 18, this being further described below.

Figure 7:
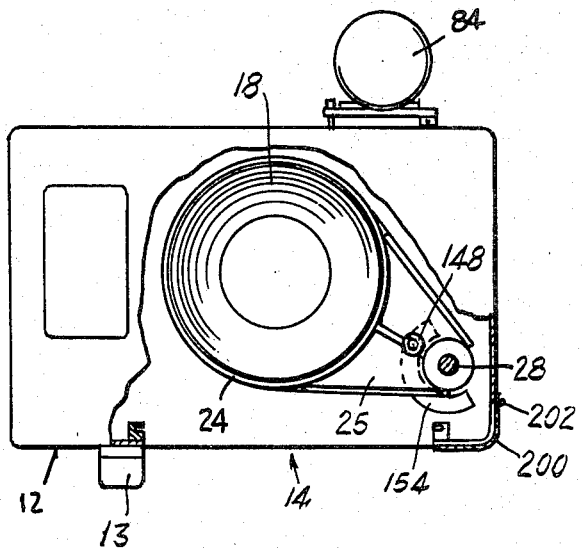
FIG. 7 is a view like FIG. 6, except illustrating the carrier supporting the spool within the housing, corresponding to the showing of FIG. 4.

Also, in accordance with the invention, there is provided an interlock switch particularly shown in FIG. 1 and designated 140, for preventing operation of the motor 84 until such time that the tray 24 has arrived at its proper angular position within the housing, namely that shown in FIGS. 1, 4 and 7. In accomplishing the motor switching, there is provided an elongate rod 142 which is slidable with respect to the arm 25, and which has a manually engageable knob 148 that can be grasped by the operator in order to lift the rod. A bearing 144 carries the rod 142.

One part or contact of the switch 140 comprises an arcuate metal block 150 which is electrically insulated from the housing member 76 by means of an insulating arcuate strip 152. A second insulating strip 154 is provided, preferably constituted by nylon, and the arrangement is such that the contact 150 remains ungrounded until such time as the rod 142 becomes positioned over aligned different-sized holes 155 in the strips 152 and 154 and in the block 150, and slips into the holes by gravity. The locations of the holes are such that contact between the rod 142 and member 150 cannot occur until the arm 22 has swung the tray 24 to the filling position of FIGS. 1, 4 and 7, at which time the rod 142 drops through the holes in the strips 150, 152 and 154, and causes electrical grounding of the member 150 by its contact therewith, due to the member having a smaller-sized hole.

By the present invention, one additional interlock switch is provided, illustrated in FIGS. 4 and 5, and comprising a switch housing 158 and actuator 159, the latter being engageable by the shutter 16, and functioning to prevent operation of the motor 84 until the shutter 16 is completely closed, as in FIG. 3.

Figure 8:
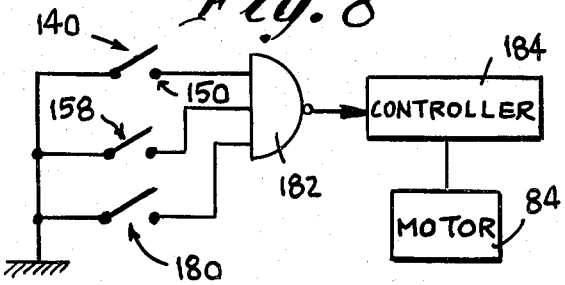
FIG. 8 is a schematic diagram of a control circuit for the electric drive motor that is employed with the equipment, and illustrating several safety interlock switches associated with the equipment.

The switches 140 and 158 are diagrammatically illustrated in FIG. 8. One or more additional switches 180 may be employed, for controlling operation of the motor 84, as for example through a suitable "nand" gate 182, which can in turn drive a motor controller 184 that preferably has variable speed control circuitry for driving the motor 84 at the desired rate. The controller 184 would also contain suitable circuitry for gradually increasing the speed during startup, and decreasing the speed as the spool becomes filled, as in FIG. 4.

The showing of FIG. 8 is merely a schematic representation of a generalized control circuit, and is not intended to be construed as the only type of control that could be employed with the equipment of the present invention. In FIG. 8, the contact member 150 is shown, constituting one of the contacts of the switch 140.

The operation of the improved spool-handling equipment of the present invention can now be readily understood by referring to the figures. With the tray 24 swung outwardly to the position shown in FIGS. 5 and 6, and in dotted outline in FIG. 2, an empty spool can be positioned on the tray. The present apparatus is intended to be used with large, heavy spools of a type that is normally too cumbersome to be lifted by hand when filled. As illustrated in applicant's U.S. Pat. No. 4,140,289, such spools are typically provided with an eye bolt at the axis, adapted to receive a hook such that the spool can be lifted and suspended by a crane or boom, etc.

Following loading of the spool on the tray 24, the latter is manually swung through the access opening 14, to a position wherein the axis of the spool coincides with the axes of the spindles 68, 88, as in FIG. 1. During such swinging movement, the rod 142 slides along the insulating strip 154 until it arrives at the holes 155 in the strips 152, 154 and block 150, thereafter dropping into the holes. This accomplishes two functions. First, an indication is provided to the operator that the angular position of the tray is such that the axis of the spool is aligned with the spindles 68, 88. In addition, when the rod 142 electrically contacts the member 150, a circuit is completed to the input of the "nand" gate 182, so as to enable the motor 84 to operate when the remaining interlock switch 158 is closed, and when the operator actuates one or more additional controls, such as switch 180, on the front control panel 13.

Figure 9:
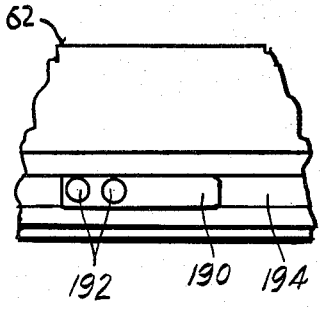
FIG. 9 is a fragmentary front elevational view of the supporting turntable of the equipment.

FIG. 9 shows a spring clip 190 secured to the turntable 62 by suitable fasteners 192. In addition, the turntable 62 has a peripheral groove 194. The clip 190 and groove 194 are useful for temporarily securing the strand of wire from the traverse mechanism 120. The wire is lightly wrapped around the clip 190 and one or two turns carefully laid into the groove 194 and then around the body of the spool 18.

With the tray 24 positioned over the turntable 62, the operator, through the control panel 13, energizes the motor 40 which effects turning of the nut 38. The screw 36 is keyed to the gear box 42, such that its rotation is prevented. Rotation of the nut 38 in the desired direction causes the tray 24 and spool 18 to move downward as a unit from the position of FIG. 4 to the position of FIG. 1. As this occurs, the conical spool flange undersurface 64 will come to rest upon the turntable 62, after which the tray 24 continues moving downwardly to the position of FIG. 1 so as to be completely out of contact with the lower portion of the spool.

Next the hydraulic lifting cylinders 106, 108 are actuated, which causes the follower member 86 to move downwardly and into engagement with the surface 110 of the spool, as in FIG. 1. It is noted that the curled-over rim 114 is intended to be received in the annular groove 112 of the follower member 86. In this way, the spool is securely held between the turntable 62 and the follower member 86.

Next, the traverse mechanism 120 is manually positioned such that the pulley 134 becomes aligned with the desired starting point on the spool 18. A strand of wire coming from a take-off supply reel (not shown) passes between the pulleys 130, 132, past the pulley 134, and is temporarily secured on the clip 190 and placed in the annular groove 194, so as to hold the wire strand in position prior to start-up of the spool 18.

The limits of reciprocation of the traverse mechanism 120 are set by the operator, through suitable adjustment means (not shown), such that the stroke of the mechanism 120 is correct for the dimensions of the particular spool 18 being employed. Automatic means may be provided for increasing the length of the stroke as the effective diameter of the wire-carrying spool 18 increases, and where the wire begins the build up on the conical flanges of the spool 18.

With the equipment ready to begin operation, the shutter 16 is closed, thereby actuating the interlock switch 158. The motor 84 is then energized, through suitable control circuitry which is selected from the control panel 13. The spool 18 is then driven, powered by the turntable 62, with the follower 86 being free-running. Wire accumulates on the spool until such time as the latter becomes full, as in FIG. 4. The motor 84 is then shut down, the shutter 16 opened, the strand extending between the pulley 134 and spool 18 cut, and the follower member 86 lifted to its raised position, as in FIG. 4. The motor 40 is then activated, causing the shaft 28 to move vertically upward, bringing the tray 24 into engagement with the lower end of the spool 18, thus raising the same off the turntable 62. This condition is illustrated in FIG. 4. The rod 142 is manually lifted by the operator, to enable the tray 24 to be swung outwardly through the access opening 14, as in FIG. 5. It is noted that as the tray is swung, the shaft 28 remains stationary; that is, it does not turn. Instead, the sleeve 27 turns with respect to the shaft 28 via the bearings 29 and 30.

From the position of FIG. 5, the spool 18 can be readily unloaded, and a new, empty spool placed in position on the tray 24.

Figure 6:
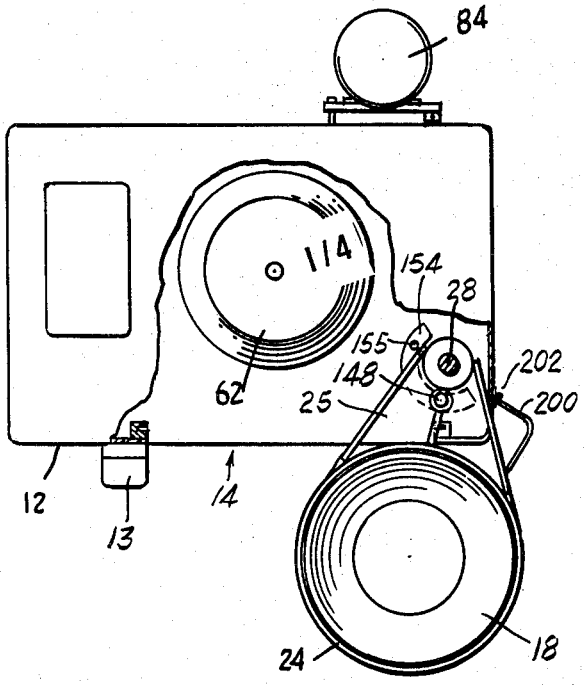
FIG. 6 is a top view of the equipment, showing the carrier supporting the spool in a position outside of the housing, corresponding to the showing of FIG. 5.

As shown in FIGS. 4, 6 and 7, there is provided on the housing a small angle-shaped door 200 which is secured to the housing by means of a hinge 202, and is maintained in the position shown in FIGS. 4 and 7 by a suitable spring arrangement. The purpose of the door 200 is to provide clearance for the arm 25 when the latter is swung outwardly as in FIG. 6. In this figure the door 200 is shown in an open position, such that the tray 24 can be positioned so as to completely clear the housing 12. Upon return of the tray 24 and arm 25 to the position of FIGS. 4 and 7, the door 200 will swing to its closed position.

The machine as above described is seen to have important advantages, resulting in an improved product that is easier to use and at the same time completely safe in operation. Due to the provision of the enclosed housing 12 and slide shutter 16, there is eliminated the possibility of the operator suffering injury from inadvertent contact with either the spool 18 or turntable 62 when they are being driven at high speeds. As noted above, the present equipment has been successfully tested with wire take-up speeds on the order of 5,000 feet per minute or more. It can be readily appreciated that under such circumstances, both the turntable 62 and spool 18 are rotating at exceptionally high rates, and the safety feature provided by the housing 12 and shutter 16 are thus important aspects of the present invention.

Also, from the standpoint of safety, the interlock switches 140 and 158 provide added safeguards. That is, the interlock 158 operates to prevent energization of the motor 84 until such time as the shutter 16 is completely closed, as in FIG. 16. Also, the switch 140 ensures that the motor 84 will not operate until such time as the carrier tray 24 has arrived at its proper angular position wherein the spool 18 is disposed over and resting upon the turntable 62.

With the present arrangement wherein the tray 24 can be manually swung so as to position the spool 18 at a location which is completely free and clear of the housing 12, loading and unloading of the spools becomes a relatively simple matter. Typically such spools are lifted by means of a suitable boom or crane, and as can be seen in FIG. 6, there is complete access to spool 18. This is very important where filled spools that weight hundreds of pounds are being employed, since such units are generally much too heavy to be loaded or unloaded by hand.

The unique arrangement wherein the hollow end flanges of the spool 18 are retained between the turntable 62 and the follower 86 has been found to provide a highly reliable mounting for the spool, with little or no likelihood of inadvertent dislodgement. The retention is significantly improved by the provision of the groove 112 in the follower 86. Failure to provide adequate retention of the spool 18 could pose a safety hazard to the operator, as well as possibly leading to problems of damage to the equipment from excess vibration, etc.

It is noted that with the present arrangement, none of the heavy lifting functions are performed manually. Instead, the motor 40 and gear box 42 are provided, cooperating with the nut 38 and screw 36. However, in the present arrangement the easier swinging movement of the tray 24 is preferably accomplished by hand. The provision of the bearings 29, 30 enables such manual swinging to be easily attained.

From the above it can now be seen that we have provided a novel spool-handling arrangement which incorporates a number of desirable features, the equipment being relatively straightforward in construction and both reliable and safe in use, even over extended periods of time. The device thus represents a distinct advance and improvement in the technology of spool-handling equipment.

Each and every one of the appended claims defines a distinct aspect of the invention, separate from the others, and accordingly each claim is to be considered in this manner when examined in any determination of novelty or validity.

Variations and modifications are possible without departing from the spirit of the invention.

What is claimed is:

1. Equipment for supporting and handling spools of the type having tapered end flanges and adapted to carry wire, comprising in combination:

(a) a housing having an access opening, (b) carrier means on the housing, having a portion movable between a raised position and a lowered position, for supporting a spool in a generally vertical position, on end at the housing exterior and for enabling shifting of said spool through said access opening to the housing interior, and for lowering the spool from a raised position to a lowered operative position after it has been shifted, (c) powered means engageable with the spool to rotate the same when said spool is in said lowered position, (d) a traverse mechanism carried by the housing, having means for guiding a strand of wire onto said spool and for reciprocating said strand along a path substantially parallel to the axis of the spool as the latter is being rotatably driven during filling of the spool with wire.

2. The invention as defined in claim 1, wherein:

(a) said carrier means comprises a tray having a central opening, (b) said spool having a rim at one end, and peripheral portions of said tray being engageable with the said rim, (c) said central opening providing a clearance space for the powered means when the tray is lowered, to enable the powered means to engage one spool end flange.

3. The invention as defined in claim 1, wherein:

(a) said powered means comprises a driven spindle on the housing, and (b) a turntable carried by the spindle and having an upper surface constituting a seat for one end flange of the spool.

4. The invention as defined in claim 3, wherein:

(a) said turntable has a generally frusto-conical configuration.

5. The invention as defined in claim 1, and further including:

(a) a free-turning follower engageable with one of the end flanges at the top of the spool, (b) said follower supporting the top of the spool against lateral displacement.

6. The invention as defined in claim 5, and further including:

(a) means for advancing and retracting the follower, to enable the spool to be installed between the follower and the powered means.

7. The invention as defined in claim 6, wherein: p1 (a) said advancing and retracting means comprises a piston and cylinder.

8. The invention as defined in claim 5, wherein:

(a) said spool has a lower end flange and an upper end flange,
(b) said follower comprises a spindle on the housing, and
(c) a turntable carried by the spindle and having a lower surface constituting a seat for the upper end flange of the spool.

9. The invention as defined in claim 8, wherein:
(a) said turntable has a generally frusto-conical configuration.

10. The invention as defined in claim 8, wherein:
(a) said upper end flange has a rim,
(b) said turntable has a peripheral groove on its underside, adapted to retain the rim of the upper end flange of the spool when the turntable is lowered, so as to hold captive the spool during high speed rotation, and thereby prevent its dislodgement.

11. The invention as defined in claim 1, wherein:
(a) said carrier means comprises a tray,
(b) an arm secured to the tray, and
(c) an operator mechanism on the housing for effecting selective lifting movement of said arm in a vertical direction, and for enabling swinging movement of the arm in a generally horizontal plane.

12. The invention as defined in claim 1, and further including:
(a) electromechanical interlock means operated by the carrier means and controlling the powered means for rotating the spool, to prevent operation of the powered means until the carrier means has moved the spool to the said operative position.

13. The invention as defined in claim 1, and further including:
(a) a shutter movable across the opening of the housing so as to close off the same and thereby prevent injury to personnel when the equipment is operating.

14. The invention as defined in claim 13, and further including:
(a) electromechanical interlock means operated by the shutter, controlling the powered means for rotating the spool, to prevent operation of the powered means until the shutter has closed off the opening.

15. The invention as defined in claim 12, wherein:
(a) said interlock means comprises a vertical slide bolt on the carrier means, and
(b) a receptacle disposed on the housing, adapted to receive the slide bolt when the carrier means is positioned with the spool over the powered means,
(c) said slide bolt locking the carrier means in a predetermined, fixed angular position with respect to the housing.

16. The invention as defined in claim 15, wherein:
(a) said receptacle is electrically insulated from the housing,
(b) said slide bolt and receptacle constituting cooperable parts of an electrical switch of said electromechanical interlock means.

17. The invention as defined in claim 15, and further including:
(a) manually engageable means on the slide bolt to enable the latter to be lifted by the operator, to thereby unlock the carrier means and enable the latter to be swung outwardly through the housing access opening.

18. The invention as defined in claim 1, and further including:
(a) mounting means for the carrier means, enabling the operator to manually swing the carrier means through the access opening.

19. The invention as defined in claim 1, wherein:
(a) said carrier means comprises a tray engageable with one end of the spool,
(b) a vertical shaft,
(c) a bearing connected with the tray and enabling swinging movement thereof with respect to the shaft,
(d) drive means for effecting vertical movement of the shaft, thereby enabling raising and lowering of the tray with respect to the housing and the powered means.

20. The invention as defined in claim 19, wherein:
(a) said drive means comprises a screw on the shaft,
(b) a nut engageable with the screw, and
(c) means for mounting the nut for turning movement with respect to the housing and shaft, and for holding the nut against axial movement.

21. The invention as defined in claim 20, and further including:
(a) an electric motor for effecting turning movement of the nut.

22. The invention as defined in claim 3, wherein:
(a) said turntable carries a clip for temporarily securing a strand of wire adjacent one flange of the spool, prior to commencement of filling of the spool with wire.

23. Equipment for supporting and rotating spools of the type having generally tapered, hollow end flanges and a central body, comprising in combination:
(a) a base,
(b) first turntable means on said base, disposed beneath and nestable in one end flange of the spool and engageable with the tapered surface of said one end flange,
(c) said turntable means supporting at least part of the weight of the spool,
(d) a second turntable means disposed above the spool, nestable in the other end flange of the spool and engageable with the tapered surface of the other end flange,
(e) powered means for driving one of said turntable means,
(f) means disposed above the spool, for advancing and retracting the said second turntable means to enable the spool to be installed between and removed from between said first and second turntable means, including means for locking the said second turntable means in its advanced position,
(g) said spool being held captive between the said first and second turntable means when the second turntable means is advanced, whereby the spool can be driven at high speeds without danger of dislodgement.

24. The invention as defined in claim 23, wherein:
(a) said advancing and retracting means comprises a hydraulic cylinder.

25. The invention as defined in claim 23, wherein:
(a) said spool is disposed with its axis generally vertical,
(b) said first turntable means comprises a turntable having a generally frusto-conical configuration, disposed below the spool and adapted to support the lower end flange of the spool.

26. The invention as defined in claim 23, wherein:

(a) said hollow end flanges comprise rims, respectively, (b) said second turnable means comprises a turntable having means for engaging one of said rims.

27. The invention as defined in claim 1, wherein:

(a) the housing has a clearance opening into which said carrier means extends when it supports the spool at the housing exterior, and (b) a closure movably mounted on the housing, for spanning and closing said access opening when the carrier means is supporting the spool in the housing interior.

28. The invention as defined in claim 27, wherein:

(a) said closure is pivotally mounted on the housing and is swingable away from the clearance opening in response to movement of the carrier means in shifting the spool to the housing exterior.

29. The invention as defined in claim 1, and further including:

(a) a brake device connected with said powered means, to effect a braking action on a spool when filled with wire.

30. The invention as defined in claim 1, wherein:

(a) the carrier means comprises a tray engageable with one spool end, (b) said powered means being separate from said tray.

31. The invention as defined in claim 30, wherein:

(a) the tray has an opening in it, (b) said powered means including a turntable drive member engageable with one end flange of the spool and operating through the said opening of the tray.

* * * * *